US008991128B2

(12) United States Patent
James

(10) Patent No.: US 8,991,128 B2
(45) Date of Patent: Mar. 31, 2015

(54) DRYWALL REPAIR KIT

(71) Applicant: Howard James, Redmond, OR (US)

(72) Inventor: Howard James, Redmond, OR (US)

( * ) Notice: Subject to any disclaimer, the term of this patent is extended or adjusted under 35 U.S.C. 154(b) by 0 days.

(21) Appl. No.: 14/049,237

(22) Filed: Oct. 9, 2013

(65) Prior Publication Data

US 2014/0102041 A1 Apr. 17, 2014

Related U.S. Application Data

(60) Provisional application No. 61/714,780, filed on Oct. 17, 2012.

(51) Int. Cl.

| | |
|---|---|
| ***E02D 37/00*** | (2006.01) |
| ***E04G 23/00*** | (2006.01) |
| ***E04F 21/00*** | (2006.01) |
| ***E04G 23/02*** | (2006.01) |

(52) U.S. Cl.

CPC ..... *E04F 21/00* (2013.01); *E04G 23/0203* (2013.01); *Y10S 52/01* (2013.01)

USPC ..... 52/514; 52/741.1; 52/749.1; 52/DIG. 1

(58) Field of Classification Search

CPC ..... E04C 2/043; E04F 13/04; E04F 21/04; E04F 21/06; E04F 21/16; E04F 21/32

USPC ..... 52/749.1, 514, DIG. 1, 741.1; 30/451; 144/28.11, 28.1; 156/94; 428/63, 138, 428/156

See application file for complete search history.

(56) References Cited

U.S. PATENT DOCUMENTS

| | | | | |
|---|---|---|---|---|
| 4,730,728 | A * | 3/1988 | Larkin | 206/315.9 |
| 4,995,605 | A * | 2/1991 | Conville | 52/770 |
| 5,996,853 | A | 12/1999 | Julius | |
| 6,024,654 | A * | 2/2000 | Chun | 473/386 |
| 6,030,298 | A * | 2/2000 | Tate | 473/408 |
| 6,409,403 | B1 | 6/2002 | Woos | |
| 6,450,723 | B1 | 9/2002 | Lithgow | |
| 6,698,100 | B2 * | 3/2004 | Yan | 30/298.4 |
| 6,733,402 | B2 * | 5/2004 | Christensen | 473/408 |
| 6,793,428 | B2 | 9/2004 | Lithgow | |
| 6,799,704 | B2 | 10/2004 | Carleton | |
| 6,820,776 | B2 | 11/2004 | Hemming et al. | |
| 6,939,070 | B2 | 9/2005 | Butz et al. | |
| 7,730,691 | B2 * | 6/2010 | Patrick | 52/514 |
| 8,024,903 | B2 * | 9/2011 | Riggs | 52/514 |
| 2005/0086889 | A1 * | 4/2005 | Shock | 52/514 |
| 2005/0204672 | A1 * | 9/2005 | Hansen | 52/514 |
| 2006/0101765 | A1 * | 5/2006 | Bailey | 52/514 |
| 2011/0311747 | A1 | 12/2011 | Lewis | |

* cited by examiner

*Primary Examiner* — Chi Q Nguyen

(74) *Attorney, Agent, or Firm* — Buckingham, Doolittle & Burroughs, LLC

(57) ABSTRACT

The subject matter disclosed and claimed herein, in one aspect thereof, is a portable drywall/plaster repair kit comprised of at least one pencil like structure comprised of a first end and a second end; a sharpener for sharpening at least one of said first end and said second end; and a cutting device for scoring or cutting the sharpened first or second end. The drywall/plaster repair kit eliminates the waiting time typically associated with other drywall/plaster repair methods and devices, and enables a user to repair a hole in drywall and/or plaster with a single application, thereby saving time.

14 Claims, 4 Drawing Sheets

DRYWALL REPAIR KIT

CROSS-REFERENCE

This application claims priority from Provisional Patent Application Ser. No. 61/714,780 filed on Oct. 17, 2012.

FIELD OF THE INVENTION

This invention relates to an easy to use repair kit for repairing a hole in drywall and/or plaster.

BACKGROUND

Oftentimes it is necessary or desirable to fix a hole (e.g., a screw hole or a nail hole) in drywall and/or plaster structures such as ceilings and walls. Heretofore, a user desiring to repair such holes would insert wet joint compound or a wet plaster mixture into the hole or opening to fill the same. However, inserting the wet compound or mixture into the hole could be both time consuming and messy, and oftentimes results in excess compound or mixture being inadvertently applied to the surface of the structure adjacent the hole or opening which must then be cleaned.

Following the application of joint compound or plaster mixture, the user must then wait until the wet compound or mixture dries and hardens, which can also be time consuming and take a day or more. Further, during the drying process, joint compound and plaster mixtures tend to shrink or contract leaving a slight indent in the structure being repaired, which often requires that the user apply a second application of the joint compound or plaster mixture to the structure to achieve a smooth finish. Of course, a second application further requires a second waiting period for the newly applied joint compound/plaster mixture to dry and harden. Once the second application of joint compound/plastic mixture has hardened, the user must typically then sand the surface to prepare the same to be primed and painted, all of which further lengthens the repair process.

Consequently, there exists in the art a long-felt need for a drywall/plaster repair kit that eliminates the waiting time typically associated with other drywall/plaster repair methods and devices. There also exists in the art a long felt need for a drywall/plaster repair kit that enables a user to repair a hole or opening in drywall and/or plaster with a single application, thereby saving time. Finally, there is a long-felt need for a drywall/plaster repair kit that accomplishes all of the forgoing objectives and that is relatively inexpensive to manufacture, and safe and easy to use.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, is a drywall repair kit that enables a user to repair a hole or opening in drywall and/or plaster with a single application, and without the wait times typically associated with other drywall/plaster repair methods and devices. In a preferred embodiment of the present invention, the drywall repair kit comprises one or more gypsum pencils, a sharpener, and a cutting device. A user can use the kit to repair relatively small openings in a drywall or plaster surface by: (i) inserting a sharpened tip of the gypsum pencil into the opening to be repaired; (ii) using the cutting device to score the exterior surface of the gypsum pencil at its intersection with the surface; and (iii) breaking the gypsum pencil at the score line, thereby ensuring that the portion of the gypsum pencil that remains in the structure is relatively flush with the surface of the structure. Upon completion, the repaired surface can immediately be primed and/or painted without the traditional wait times associated with permitting the wet joint compound/plaster mixtures to dry, harden and be sanded. Moreover, the remaining portion of the gypsum pencil may be sharpened with the sharpener and reused to fill another opening. Finally, no prior construction or specialized knowledge or know-how is required to use the drywall repair kit of the present invention.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1:
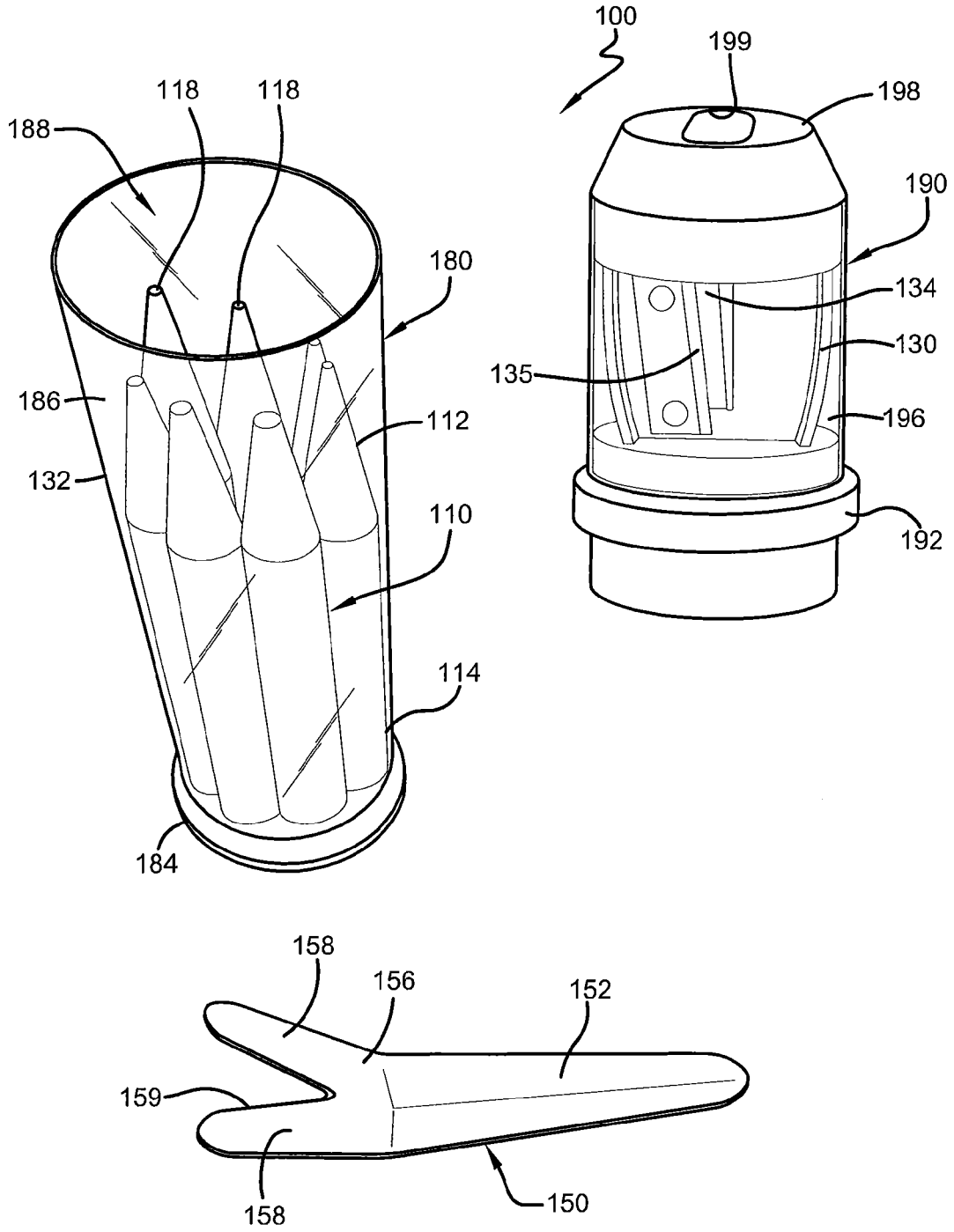
FIG. 1 is a perspective view of a preferred embodiment of the contents of the drywall repair kit of the present invention.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details.

Referring initially to the drawings, FIG. 1 is a perspective view of a preferred embodiment of the contents of the drywall repair kit 100 of the present invention which is preferably comprised of a pencil like structure 110, a sharpener 130, and a cutting device 150, all of which may be packaged, transported and stored in a container 180. Pencil like structure 110 is preferably a generally elongated cylindrical member having a first end 112, an opposing second end 114, and an exterior surface 116. Pencil like structure 110 is further preferably comprised of a hardened gypsum-based powder.

In a preferred embodiment of the present invention, pencil like structure 110 is between three and seven inches in length, as measured between first end 112 and second end 114, and between ¼ and ¾ of an inch in diameter. Nonetheless, it is contemplated that pencil like structure 110 could come in other shapes and sizes without affecting the overall concept of the invention.

Sharpener 130 can be any type of sharpener known in the art, such as a pencil sharpener or other sharpening device used to sharpen the end of an instrument (e.g., a wooden pencil) to a point. In a preferred embodiment, sharpener 130 is comprised of a housing 132 with a generally conically shaped opening 134 therein and a blade 135 partially positioned within said opening 134 so that when, for example, first end 112 of pencil like structure 110 is inserted into said opening 134 and rotated in a clockwise direction, blade 135 shapes first end 112 into a point 118.

Figure 2:
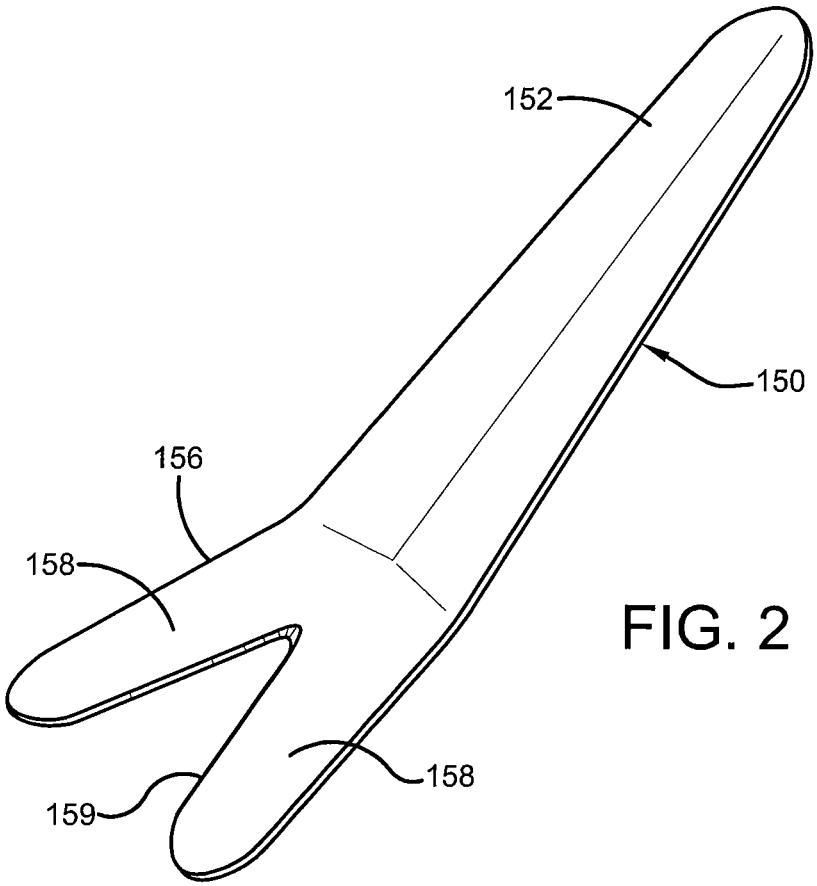
FIG. 2 is a perspective view of a preferred embodiment of the cutting device of the present invention.

As best illustrated in FIGS. 1 and 2, cutting device 150 is an elongated partially bent member comprised of a handle portion 152 and a forked portion 156 with a pair of legs 158 extending outwardly from said forked portion 156 and away from handle portion 152. Said legs 158 form an opening 159 therebetween for receipt of first end 112 of pencil like structure 110. Each of legs 158 may be beveled and/or sharpened on the side of leg 158 nearest opening 159, and the legs 158 are meant to be generally flush with the surface being repaired when cutting device 150 is in use. As explained more fully below, cutting device 150, and legs 158 in particular, can be used to scribe or cut a fault line into first end 112 of pencil like structure 110, thereby weakening the same and enabling a user (not shown) to snap or break pencil like structure 110 at the fault line when desired.

As previously stated, FIG. 1 is a perspective view of a preferred embodiment of the contents of drywall repair kit 100, which may be purchased and/or stored in container 180. Container 180 can come in a variety of shapes, sizes, designs and orientations to suit user need and/or preference. Nonetheless, in a preferred embodiment of the present invention, container 180 is comprised of a first compartment 182 and a second compartment 190 that may be removably attached to one another in stacked fashion such that second compartment 190 rests atop of first compartment 182. First compartment 182 may be further comprised of a bottom 184 and a wall 186 extending therefrom to define an interior space 188 for storing a plurality of pencil like structures 110 and cutting device 150. Interior space 188 may also contain a silica pack (not shown), as is known in the art for removing moisture therefrom.

Second compartment 190 may further comprise a bottom 192, a wall 194 extending therefrom, and a top 198 that defines an interior space 196. Interior space 196 may house sharpener 130 and a continuous opening 199 in top 198 as shown in FIG. 1 allows a user (not shown) to insert first end 112 of pencil like structure 110 into sharpener opening 134 without removing sharpener 130 from second compartment 190. In this manner, a user (not shown) can sharpen pencil like structure 110 and contain the shavings and dust created thereby in second compartment 190 for subsequent disposal.

Figure 3:
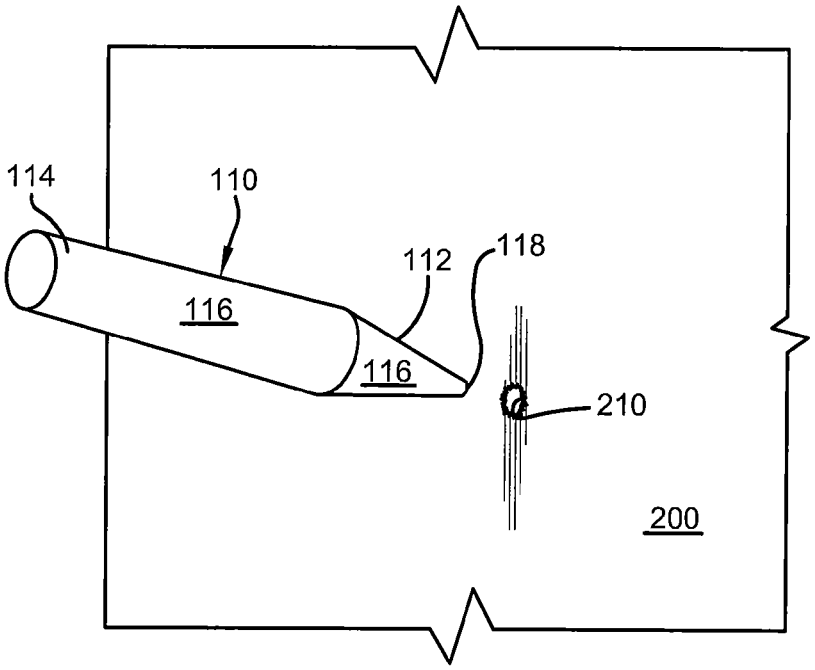
FIG. 3 illustrates a perspective view of a preferred embodiment of the pencil like structure in proximity to an opening in a surface.
Figure 4:
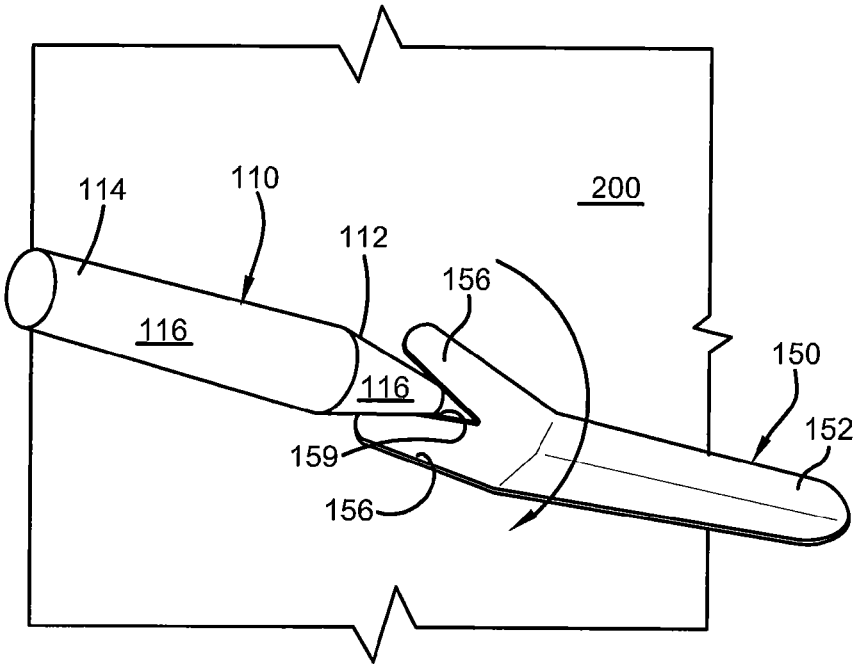
FIG. 4 illustrates a perspective view of the tip of the pencil like structure inserted into the opening of FIG. 3 and being scored with a preferred embodiment of the cutting device.
Figure 5:
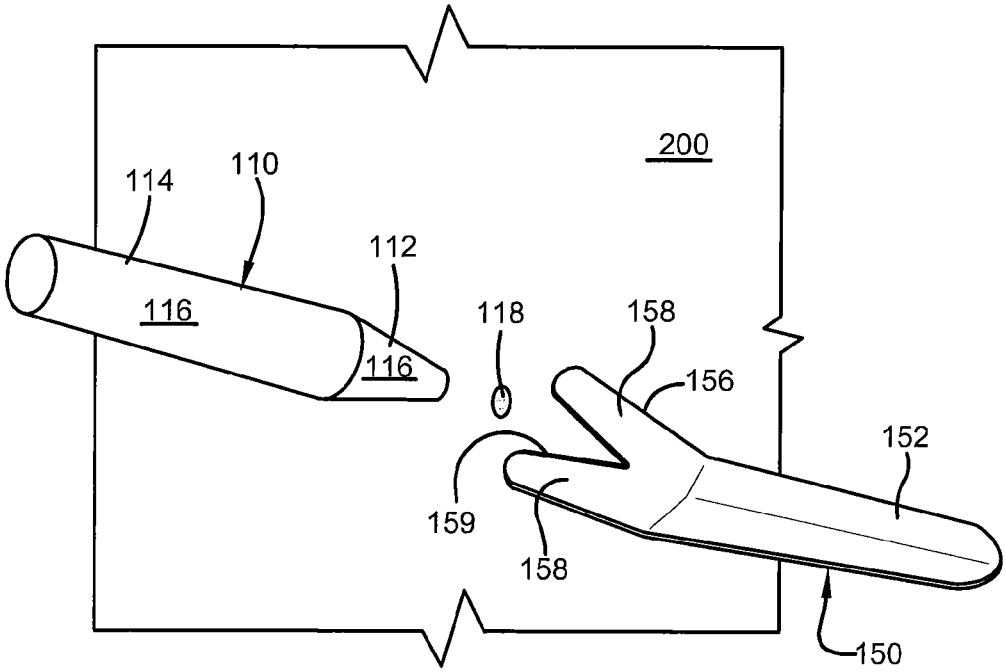
FIG. 5 is a perspective view of the pencil like structure and the opening following the repair.

Having described the overall structure and contents of a preferred embodiment of repair kit 100, the use and usefulness of the same will now be summarized. A user (not shown) desiring to repair a small opening 210 in a structure 200, such as a drywall or plaster wall or ceiling, would simply insert point 118 of pencil like structure 110 into opening 210, as best illustrated in FIG. 3. The user (not shown) would then use cutting device 150 to score or cut the circumference of pencil like structure 110 immediately adjacent to opening 210, as best illustrated in FIG. 4. More specifically, the user would cause each of legs 158 of cutting device 150 to straddle pencil like structure 110 and then the user would rotate cutting tool 150 around pencil like structure 110, thereby scoring or creating a fault line (not shown) on the exterior surface 116 of pencil like structure 110 immediately adjacent to opening 210. The user (not shown) would then apply slight lateral pressure to pencil like structure 110 thereby causing the same to break at the fault line created by cutting tool 150 and the point 118 would remain in opening 210 and be relatively flush with the surface of structure 200, as best illustrated in FIG. 5. At this point, the user (not shown) can immediately prime and/or paint structure 200 and is not required to wait for traditional joint compound or plaster patch to dry. Additionally, first end 112 of pencil like structure 110 can be sharpened with sharpener 130 to create a new point 118 so that pencil like structure 110 can be used again.

Accordingly, the drywall/plaster repair kit 100 of the present invention eliminates the waiting time typically associated with other drywall/plaster repair methods and devices. The drywall/plaster repair kit 100 also enables a user to repair a hole in drywall and/or plaster with a single application, thereby saving time. Finally, the drywall/plaster repair kit 100 is relatively inexpensive to manufacture, and safe and easy to use.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A repair kit for repairing an opening in a drywall or plaster structure comprising:

at least one elongated member comprised of a first end and a second end, wherein said elongated member has a generally uniform cross section along at least a portion of said elongated member; wherein said at least one elongated member is comprised of gypsum a sharpener for sharpening at least one of said first end and said second end; and a cutting device, wherein said cutting device is further comprised of a handle portion and a forked portion.

2. The repair kit of claim 1 wherein said kit is comprised of a plurality of elongated members.

3. The repair kit of claim 1 wherein said handle portion extends at an angle from said forked portion.

4. The repair kit of claim 1 further comprising a container for storing the at least one elongated member, the sharpener and the cutting device.

5. The repair kit of claim 4 wherein said container further comprises a first compartment and a second compartment.

6. The repair kit of claim 5 wherein said second compartment houses said sharpener and further comprises a top with an opening therein to enable a user to sharpen said at least one elongated member with the sharpener without removing said sharpener from said second compartment.

7. A drywall repair kit comprising:

at least one generally cylindrical elongated member comprised of a first end, a second end and an exterior surface; wherein said at least one generally cylindrical elongated member is comprised gypsum a sharpener for sharpening said first end into a point; and a cutting device for scoring the exterior surface of said at least one generally cylindrical elongated member; wherein said cutting device is further comprised of a handle portion and a forked portion comprised of two legs and an opening therebetween.

8. The drywall repair kit of claim 7 wherein said kit is comprised of a plurality of generally cylindrical elongated members.

9. The drywall repair kit of claim 7 wherein said handle portion extends at an angle from said forked portion.

10. The drywall repair kit of claim 7 further comprising a container for storing the at least one generally cylindrical elongated member, the sharpener and the cutting device.

11. The drywall repair kit of claim 10 wherein said container further comprises a first compartment and a second compartment.

12. The drywall repair kit of claim 11 wherein said second compartment further comprises a top with a continuous opening therein.

13. A method for using a kit to repair an opening in a drywall or plaster structure, wherein said kit comprises at least one elongated member with a point and a cutting device, comprising:

inserting said point of said at least one elongated member into said opening;

using said cutting device to score a fault line into an outside surface of said at least one elongated member adjacent to said opening wherein cutting device is further comprised of a handle portion and a forked portion; and breaking said at least one elongated member at said fault line; and wherein said at least one elongated member is comprised of gypsum.

14. The method of claim 13 wherein said handle portion extends at an angle from said forked portion.

* * * * *